US011118424B2

(12) United States Patent
Greci et al.

(10) Patent No.: US 11,118,424 B2
(45) Date of Patent: Sep. 14, 2021

(54) REMOTE CONTROL FLOW PATH SYSTEM FOR GRAVEL PACKING

(71) Applicant: Halliburton Energy Services, Inc., Houston, TX (US)

(72) Inventors: Stephen Michael Greci, Little Elm, TX (US); Thomas Jules Frosell, Irving, TX (US); Michael Linley Fripp, Carrollton, TX (US); Gary John Geoffroy, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/326,321

(22) PCT Filed: Mar. 23, 2018

(86) PCT No.: PCT/US2018/024011
§ 371 (c)(1),
(2) Date: Feb. 18, 2019

(87) PCT Pub. No.: WO2019/182610
PCT Pub. Date: Sep. 26, 2019

(65) Prior Publication Data

US 2021/0115758 A1 Apr. 22, 2021

(51) Int. Cl.
*E21B 34/06* (2006.01)
*E21B 34/16* (2006.01)
(Continued)

(52) U.S. Cl.
CPC ..... *E21B 34/066* (2013.01); *E21B 34/06* (2013.01); *E21B 34/16* (2013.01); *E21B 43/04* (2013.01); *E21B 43/12* (2013.01); *E21B 47/12* (2013.01)

(58) Field of Classification Search
CPC ..... E21B 34/066; E21B 43/12; E21B 43/04; E21B 34/16; E21B 47/12
See application file for complete search history.

(56) References Cited

U.S. PATENT DOCUMENTS 6,230,803 B1 5/2001 Morton et al.
6,349,772 B2 2/2002 Mullen et al.
(Continued)

FOREIGN PATENT DOCUMENTS

WO 2005064113 7/2005
WO WO-2017058256 A1 * 4/2017 ..... E21B 34/14

OTHER PUBLICATIONS

ISRWO International Search Report and Written Opinion for PCT/US2018/024011 dated Dec. 7, 2018.
(Continued)

*Primary Examiner* — Michael R Wills, III
(74) *Attorney, Agent, or Firm* — Scott Richardson; C. Tumey Law Group PLLC

(57) ABSTRACT

Methods and systems for a remote control flow path system in a wellbore. In one embodiment, the system comprises a plurality of transceivers spaced in the wellbore; a telemetry module operable to wirelessly receive control signals from a surface location by way of the plurality of transceivers and to wireless transmit signals to the surface location by way of the plurality of transceivers; a control module comprising a controller, a pump, and a reservoir of hydraulic fluid; a plurality of valves; and a plurality of control lines for the hydraulic fluid, wherein the plurality of control lines are disposed between the pump and the plurality of valves; wherein the control module is operable to hydraulically actuate one or more of the valves to open or closed positions in response to the control signals from the surface location to create one or more flow paths in the wellbore.

20 Claims, 6 Drawing Sheets

(51) Int. Cl.

| | |
|---|---|
| ***E21B 43/04*** | (2006.01) |
| ***E21B 43/12*** | (2006.01) |
| ***E21B 47/12*** | (2012.01) |

(56) References Cited

U.S. PATENT DOCUMENTS

| | | | | |
|---|---|---|---|---|
| 8,191,631 | B2 | 6/2012 | Clem et al. | |
| 8,496,055 | B2 | 7/2013 | Mootoo et al. | |
| 8,596,359 | B2 | 12/2013 | Grigsby et al. | |
| 9,388,661 | B2 | 7/2016 | Jasek | |
| 2005/0121192 | A1 | 6/2005 | Hailey, Jr. et al. | |
| 2008/0128130 | A1 | 6/2008 | Whitsitt et al. | |
| 2010/0163235 | A1 | 7/2010 | Mootoo et al. | |
| 2010/0294495 | A1 | 11/2010 | Clarkson et al. | |
| 2012/0031494 | A1 | 2/2012 | Lymberopoulos | |
| 2012/0043079 | A1 | 2/2012 | Wassouf et al. | |
| 2017/0114615 | A1* | 4/2017 | Saldanha | E21B 44/00 |
| 2017/0247959 | A1 | 8/2017 | Dirksen et al. | |
| 2018/0058202 | A1* | 3/2018 | Disko | E21B 47/017 |
| 2018/0058209 | A1* | 3/2018 | Song | E21B 47/017 |
| 2018/0283133 | A1* | 10/2018 | Poluchalla | E21B 33/124 |
| 2018/0283136 | A1* | 10/2018 | Poluchalla | E21B 43/14 |
| 2020/0325759 | A1* | 10/2020 | Sharma | E21B 49/006 |

OTHER PUBLICATIONS

Carlson et al., "Sand Control: Why and How?", Schlumberger Technology Corporation., 1992, pp. 41-53.

* cited by examiner

REMOTE CONTROL FLOW PATH SYSTEM FOR GRAVEL PACKING

BACKGROUND

Gravel packing operations are a type of subterranean operation. Typically, a gravel packing operation is used to reduce the migration of unconsolidated or loosely consolidated formation particulates into a wellbore. Migration of unconsolidated or loosely consolidated formation particulates may cause a variety of problems. Examples of these problems may include, the formation of voids behind the pipe which may cause formation subsidence and casing collapse, particulate materials being produced at the surface which may cause abrasive wear to components within a production assembly, partially or fully clogging a production interval, and causing damage to production assemblies due to erosion or plugging. During gravel packing operations, gravel such as sand/proppant may be carried to a wellbore by a gravel packing fluid, which may be gelled to increase its viscosity and improve its ability to carry gravel. The gravel packing fluid may be pumped into a wellbore in which the gravel pack is to be placed. The base fluid of the gravel packing fluid may leak off into the subterranean zone and/or return to the surface while the gravel is left in the zone to form a gravel pack. The resultant gravel pack may act as a filter to separate formation sands from produced fluids while permitting the produced fluids to flow into the wellbore. Typically, gravel packing operations may involve placing a gravel pack screen in the wellbore and packing the surrounding annulus between the screen and the wellbore with gravel designed to prevent the passage of formation sands through the pack. Such gravel packs may be used to stabilize the formation while causing minimal impairment to well productivity.

The implementation of a gravel pack may include running a completion assembly on a service tool downhole. The completion assembly may include a screen, shear sub, blank pipe, a packer assembly, and sump packer seal assembly. The packer may then be set and the completion assembly may be released from the packer. The service tool may be manipulated downhole to obtain proper positioning to control fluid flow downhole. The service tool may be manipulated into different positions such as, a squeeze position, a circulating position, and a reverse circulation position.

For example, the service tool may be manipulated into a "squeeze position," in which the service tool may be positioned so that the return ports may be sealed. Sealing the return ports may stop return flow thereby preventing circulation. In turn, all of the base fluid pumped down the work string may then be forced to leak off into the formation. The squeeze position may be used to test the packer, obtain injection rates, and force acid or slurry into the perforations.

Additionally, the service tool may be manipulated into a "circulating position." This requires manipulating the flow paths to allow fluid slurry into the annulus area formed between the screen and the base pipe. The slurry may include a liquid carrier and particulate material, such as gravel or other proppants. The flow path for slurry to be pumped downhole may include a work string, a crossover port in the completion assembly, a closing sleeve port in the assembly, and a lower annulus between the screen and the base pipe. The particulate material may be deposited in the lower annulus area to form a gavel pack. The gravel pack may be highly permeable for the flow of hydrocarbon fluids but may block the flow of the fine particulate materials carried in the hydrocarbon fluids. The liquid carrier may then flow into the formation or inside of the screen and up the wash pipe where it may be returned through the top port into an upper annulus area.

The service tool may also be manipulated into a "reverse-out position" in which the top port and the crossover port are repositioned to be above the packer. Fluid circulation may occur at the top of the packer, either forward (e.g. down the work string pipe) or reverse (e.g. down the upper annulus). The completion assembly may include a reverse ball check that may prevent fluid losses down the wash pipe into the formation. The service tool is then removed from the wellbore and the wellbore is prepared for installation of an uphole production tubing assembly.

Although effective, such implementations may require tool movement to create the desired flow paths to place fluids pumped downhole in a specified location. Tool movement may be difficult and cause uncertainty in the position of the tool.

BRIEF DESCRIPTION OF THE DRAWINGS

These drawings represent certain aspects of the present invention and should not be used to limit or define the disclosure.

DETAILED DESCRIPTION

The systems and methods disclosed herein relate to subterranean operations and, more particularly, to gravel packing operations. Provided are methods and systems for remotely operating a variety of valves in a service tool in order to perform operations necessary to complete a gravel packing treatment. By remote operation, the valves may be operated without any manipulation of the tool string and without any control lines from surface. The system may also allow for 2-way wireless communication from surface to service tool to provide status updates, valve locations, and the like. Eliminating tool movement may be an improvement in deep wells in that it may be able to eliminate uncertainty in position of the service tool with respect to the other downhole tools. Another advantage may be that for both the length of the tool assemblies, may be reduced, improving basket fitment, handling, and cost. It should be noted, that the following embodiments may also be utilized during frac packing operations in addition to changing out fluids in a wellbore and should not be limited to gravel packing operations.

A downhole pump controlled by a wireless telemetry module may be used to generate pressure needed downhole to open and close valves creating a variety of flow paths.

Figure 1:
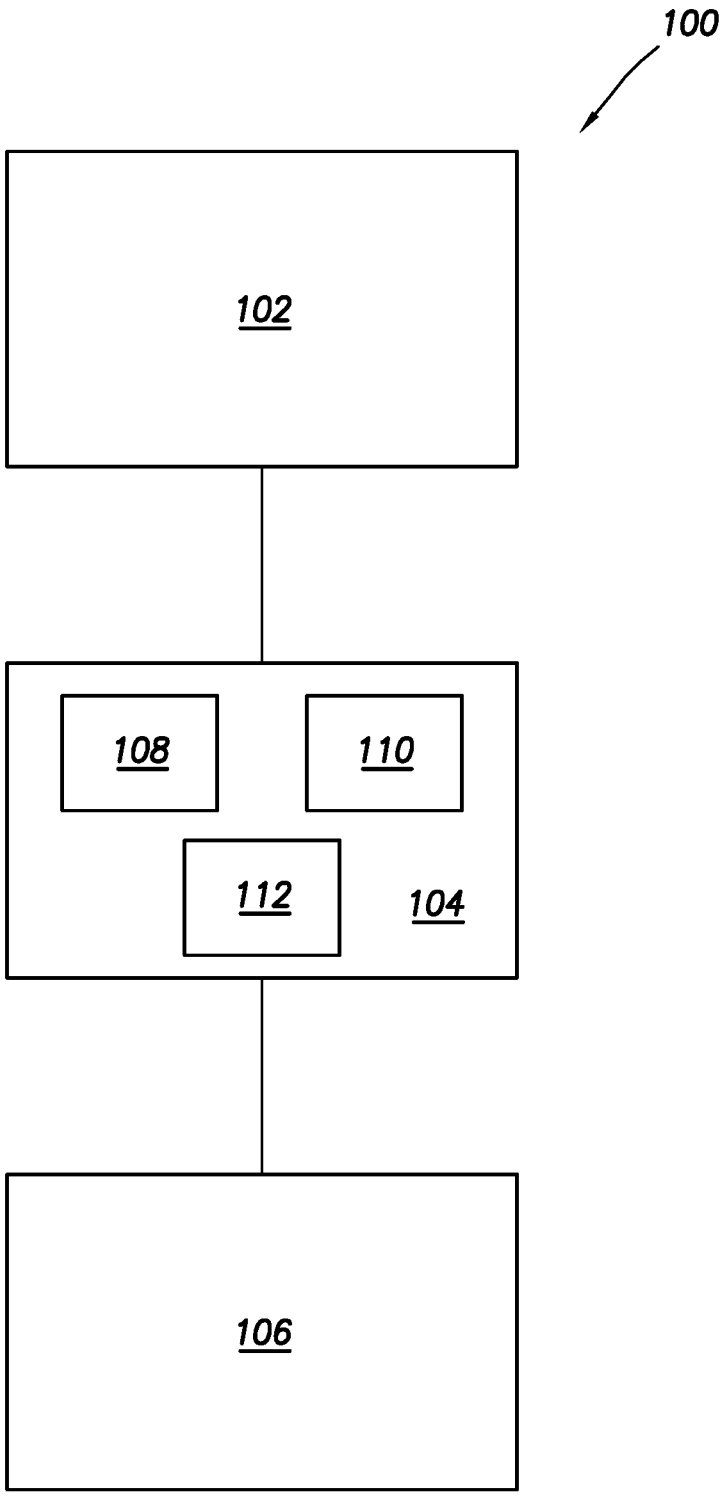
FIG. 1 illustrates a schematic diagram of a system for remotely manipulating valve position of a downhole tool.

FIG. 1 illustrates a schematic diagram of a system for remotely manipulating the position of a valve in a downhole tool to create specific flow paths. In a non-limiting example, system 100 may comprise a telemetry module 102, a control module 104, and a flow control module 106. System 100 may be used to create a flow paths needed to deliver desired fluids downhole.

Telemetry module 102 may be any suitable telemetry module 102 capable of wireless communication in a wellbore. Telemetry module 102 may be capable of any suitable type of communication. In a non-limiting example, suitable communication may include, but is not limited to, electromagnetic signals, acoustic signals, or any combination thereof. In a non-limiting example, telemetry module 102 may be capable of two-way communication. By way of example, telemetry module 102 may include acoustic and/or vibratory devices that send and receive acoustic signals along the tubing (e.g., work string pipe 202 on FIG. 6). Telemetry module 102 may wirelessly transmit signals (directly or indirectly) to and from a surface location. Control signals received from the surface may then be communicated to control module 104. Communication between telemetry module 102 and control module 104 may be wired or wireless, as desired for a particular application. Control module 104 may receive a signal from telemetry module 102 indicating which ports on the completion tool are to be opened. While shown as a separate component, telemetry module 102 may be a component of control module 104. Control module 104 may include a pump 108. Pump 108 may be any suitable pump capable of pressurizing a control line. Suitable pumps 108 may include, but are not limited to, a hydraulic pump and a piezo-electric pump, among others. Control module 104 may also include a controller 110. Controller 110 may receive the signal received from telemetry module 102 to thereby select the appropriate control line. In an embodiment, all control lines may be self-contained in a single tool and disposed downhole as a single piece. Control module 104 may include equipment (not shown individually), such as an electronics package (not shown) that may include a microprocessor among other electronics, to receive the signal from telemetry module, activate pump and select the control line. Control module 104 may also include solenoids (not shown) that may connect and/or disconnect pressurized control lines (not shown) to the pump 108. Control module 104 may also comprise a rotary timing valve and a position-controlled motor which may connect and/or disconnect the pressurized control lines (not shown). Control module 104 may activate pump 108, for example, in response to the signals received from the surface by way of telemetry module 102. Pump 108 may then utilize reservoir 112 of hydraulic fluid to pressurize the selected control line, which in turn may manipulate flow control module 106 to create the desired flow path. Reservoir 112 may include any suitable hydraulic fluid capable of pressurizing the selected control line. Suitable hydraulic fluids may include, but are not limited to, water, mineral oil, silicon oil, other synthetic or natural based fluids, and/or any combination thereof. Flow control module 106 may comprise a plurality of valves disposed within the wellbore. The pressurized control line may open or close a valve located within the wellbore. More than one valve may be opened or closed simultaneously. Pressurized control line may also open or close a sleeve located on the downhole tool. By opening and closing valves and/or opening and closing sleeves, flow control module 106 may be able to create flow paths needed to perform a gravel packing operation. Control module 104 may also provide feedback to the surface operator by way of telemetry module 102. The feedback may verify that the process has been completed for example, via pressure signals and or volume displacement.

Once completion operations have concluded, control module 104 (referring to FIG. 1) may trigger the release device to disconnect the first downhole tool (discussed below) from the second downhole tool (discussed below) of the completion tool. The second downhole tool may then be removed from the well and may be transferred to a different well and/or site, where it may then be used in a different completion operation. Any suitable release device may be used. In a non-limiting example, the release device may include a ratch latch, shear pins, screws, lugs, threads, snap rings, and/or any combination thereof.

Figure 2:
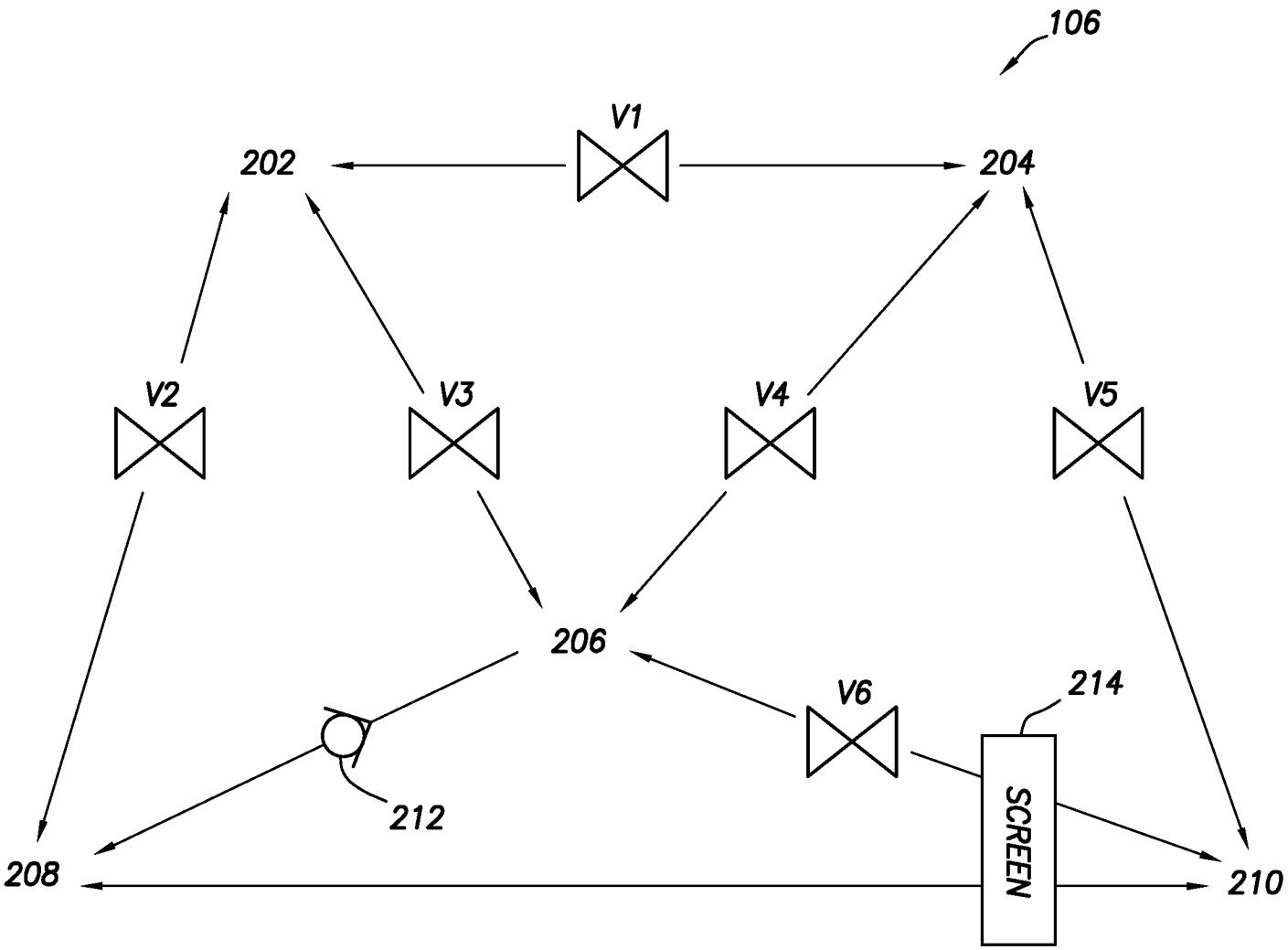
FIG. 2 illustrates a schematic diagram depicting a flow control module for creation of flow paths downhole.

FIG. 2 illustrates a flow control module 106 for creation of flow paths downhole, for example, during a gravel packing operation. There may be a plurality of valves V1-V6 disposed within a downhole tool in such a way as to create specific flow paths by way of opening or closing valves V1-V6. Any suitable valve V1-V6 may be used. Suitable valves may include, but are not limited to, a piston valve, a spool valve, a globe valve, a diaphragm valve, a gate valve, a pinch valve, a poppet valve, a butterfly valve, a ball valve, a knife valve, needle valve, sliding sleeves, and/or any combination thereof. Each of valves V1-V6 may be opened or closed by way of hydraulic pressure. In an embodiment, an operator may determine the desired position of the completion tool. The operator may then perform the necessary functions to open and/or close specific valves to create the flow paths. The following embodiments may be a non-limiting example of a configuration flow paths and valves V1-V6 located in a wellbore. There may be a valve V1 disposed at a location between work string pipe 202 and a first annulus 204. First annulus may be disposed between work string pipe 202 and the casing. Valve V2 may be disposed at a location between the work string pipe 202 and a second annulus 208. Second annulus 208 may be between the gravel packing screen 214 and the casing. Additionally, valve V3 may be disposed at a location between the work string pipe 202 and the wash pipe 206. Also, valve V4 may be disposed at a location between wash pipe 206 and first annulus 204. Valve V5 may be disposed at a location between first annulus 204 and third annulus 210. Third annulus 210 may be located between the wash pipe 206 and screen 214. Valve V6 may be disposed at a location between wash pipe 206 and third annulus 210 located between the wash pipe and the screen. Optionally, there may be additional flow paths within the wellbore that may not be controlled by a valve. For example, there may be a flow path between second annulus 208 and the casing and third annulus 210 located between the wash pipe 206 and the screen 214. Additionally, there may be a check valve 212 disposed within a flow path. For example, check valve 212 may be disposed at a location between wash pipe 206 and second annulus 208. Check valve 212 may allow fluid from wash pipe 206 to second annulus 208, but not allow fluid from second annulus 208 into wash pipe 206.

Figure 3:
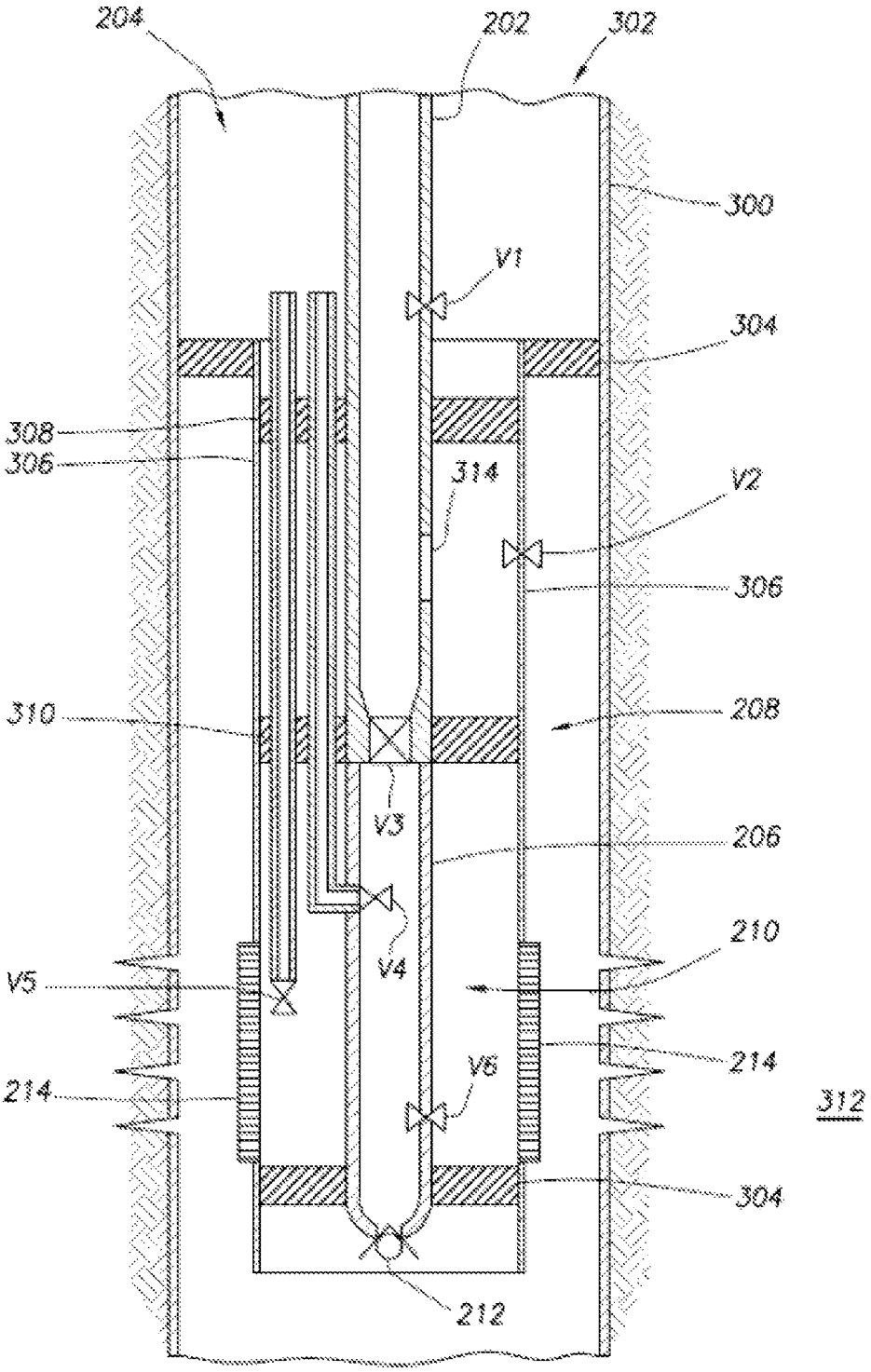
FIG. 3 illustrates valve placements and positions within the wellbore to create the flow paths of FIG. 2.

FIG. 3 illustrates a plurality of valves V1-V6 disposed in a wellbore outfitted with equipment for well completion. Wellbore 302 may be lined with casing 300. Disposed within casing 300 may be work string pipe 202. Work string pipe 202 may be capable of delivering fluids downhole. Below work string pipe 202 may be wash pipe 206. In an embodiment, a valve V1-V6 may be disposed at the interface between work string pipe 202 and wash pipe 206. Wash pipe 206 may be any suitable pipe or other conduit capable of creating an annular flow path suitable for return flow. Wash pipe 206 may also function to transport returns up work string pipe 202. In an embodiment, the annular flow path may be located interiorly to screen 214. Adjacent to the bottom of wash pipe 206 may be screen 214. In an embodiment, a plurality of screens 214 may be disposed downhole. Any suitable screen 214 capable of supporting gravel packs of various sizes may be used. Screen 214 may be disposed in wellbore 302 on tubing 306. Any suitable tubing 306 capable of withstanding completion operations may be used. Packer 304 or a plurality of packers 304 may be disposed within wellbore 302. Any suitable packer 304 capable of isolating a specified zone in wellbore 302 may be used. In an embodiment, packer 304 may be disposed between tubing 306 and casing 300 thereby isolating first annulus 204 from second annulus 208. First seal assembly 308 may be disposed between tubing 306 and work string pipe 202 thereby isolating first annulus 204 from a port 314 of the work string pipe 202. In an embodiment, port 314 may be located in work string pipe 202. Second seal assembly 310 may be disposed between wash pipe 206 and tubing 306 thereby isolating third annulus 210 from port 314 of work string pipe 202. In an embodiment, first seal assembly 308 and second seal assembly 310 may be the same seal assembly. In an embodiment, first seal assembly 308 and second seal assembly 310 may be different seal assemblies. Any suitable seal assembly may be used may be used for first seal assembly 308 and second seal assembly 310.

Valves V1-V6 may be disposed in wellbore 302 at various locations. Valves V1-V6 may be opened and/or closed at any given time thereby creating a specific flow path within wellbore 302. Flow paths within wellbore 302 may deliver fluids to a specific area within wellbore 302. In an embodiment, an operator may specify a desired flow path wherein the appropriate valves V1-V6 may then be opened and/or closed. Valve V1 may be disposed between first annulus 204 and an interior of work string pipe 202. Valve V2 may be disposed between tubing 306 and second annulus 208. When open, valve V2 may provide fluid communication between an interior of work string pipe 202 and second annulus 208. Valve V3 may be disposed between work string pipe 202 and wash pipe 206. When open, valve V3 may provide fluid communication between from interior of work string pipe 202 to interior of wash pipe 206. Valve V4 may be disposed in a flow channel between wash pipe 206 and first annulus 204. When open, valve V4 may provide fluid communication between first annulus 204 and an interior of wash pipe 206. Valve V5 may be disposed in a flow path between first annulus 204 and third annulus 210. When open, valve V5 may provide fluid communication between first annulus 204 and third annulus 210. Valve V6 may be disposed between wash pipe 206 and third annulus 210. When open, valve V6 may provide fluid communication between an interior of wash pipe 206 and third annulus 201. It should be understood that FIG. 3 is merely illustrative and other configurations of valves V1-V6 may be used for a particular application.

In another non-limiting example, valve V3 may be opened. With valve V3 opened, fluid may be flowed down work string pipe 202 and through valve V3 into wash pipe 206. The fluid may flow out check valve 212 in bottom of wash pipe 206 with the other valves V1, V2, V4, V5, and V6 closed and packer 304 not yet set. This may be desirable to wash out work string pipe 202 and wash pipe 206 when running into wellbore 302 to enable placement of wash pipe at a desired depth.

In a non-limiting example, valve V1 and valve V2 may be opened to provide fluid communication between first annulus 204 and second annulus 208 by way of work string pipe 202. While valve V1 and V2 are open, valve V3 may be closed. As illustrated, a fluid may flow down first annulus 204 and through valve V1 into work string pipe 202. The fluid may exit work string pipe 202 by way of port 314 and flow into second annulus 208. Any suitable fluid may be introduced into second annulus 208 by way of work string pipe 202 through valve V1 and V2. Suitable fluids may include, but are not limited, acids, breakers, gravel pack fluids, any combination thereof, and/or the like. Gravel pack fluids may include a carrier fluid (e.g., water, aqueous linear gels, aqueous crosslinked gels, and surfactant gels) and gravel (e.g., sand or other suitable particulates).

In another non-limiting example, valve V2 may be opened to provide communication between work string pipe 202 and second annulus 208 by way of port 314 in work string pipe 202. In this example, all the other valves, such as valve V1, valve V3, valve V4, valve V5, and valve V6, may be closed. In this position, a squeeze gravel pack may be performed. In the squeeze gravel pack, fluid may be directed down work string pipe 202 and into second annulus 208 by way of port 314 in work string pipe 202. The fluid may then be squeezed from second annulus 208 into formation 312.

In another non-limiting example, valves V2, V4, and V6 may be opened. In this position, the other valves V1, V3, and V5 may be closed. A circulating gravel pack may be performed. In the circulating gravel pack, fluid may circulate down work string pipe 202, through valve V2, and into second annulus 208. The fluid may then return by being forced through screen 214, through valve V6 and into wash pipe 206, and through valve V4 into first annulus 204. This may allow for the pressure within the first annulus 204 to be monitored during the pumping of fluid (e.g. slurry). Additionally, this flow path may help induce screen out by forcing the returns through screen 214 and into wash pipe 206, where the fluid may then flow around downhole tools (discussed below) and through valve V4.

In another non-limiting, valve V1 may be opened while the other valves V2-V6 may be closed. This flow path may be created, for example, to reverse out left over gravel from work string pipe 202. In a reverse out, the fluid may be pumped down first annulus 204, flow through valve V1 and then into work string pipe 202. This flow path may be used to clean out work string pipe 202 after pumping the gravel pack and prior to pulling work string pipe out of wellbore 302. In an embodiment, all of the above flow paths may also be created during frac packing operations.

Figure 4:
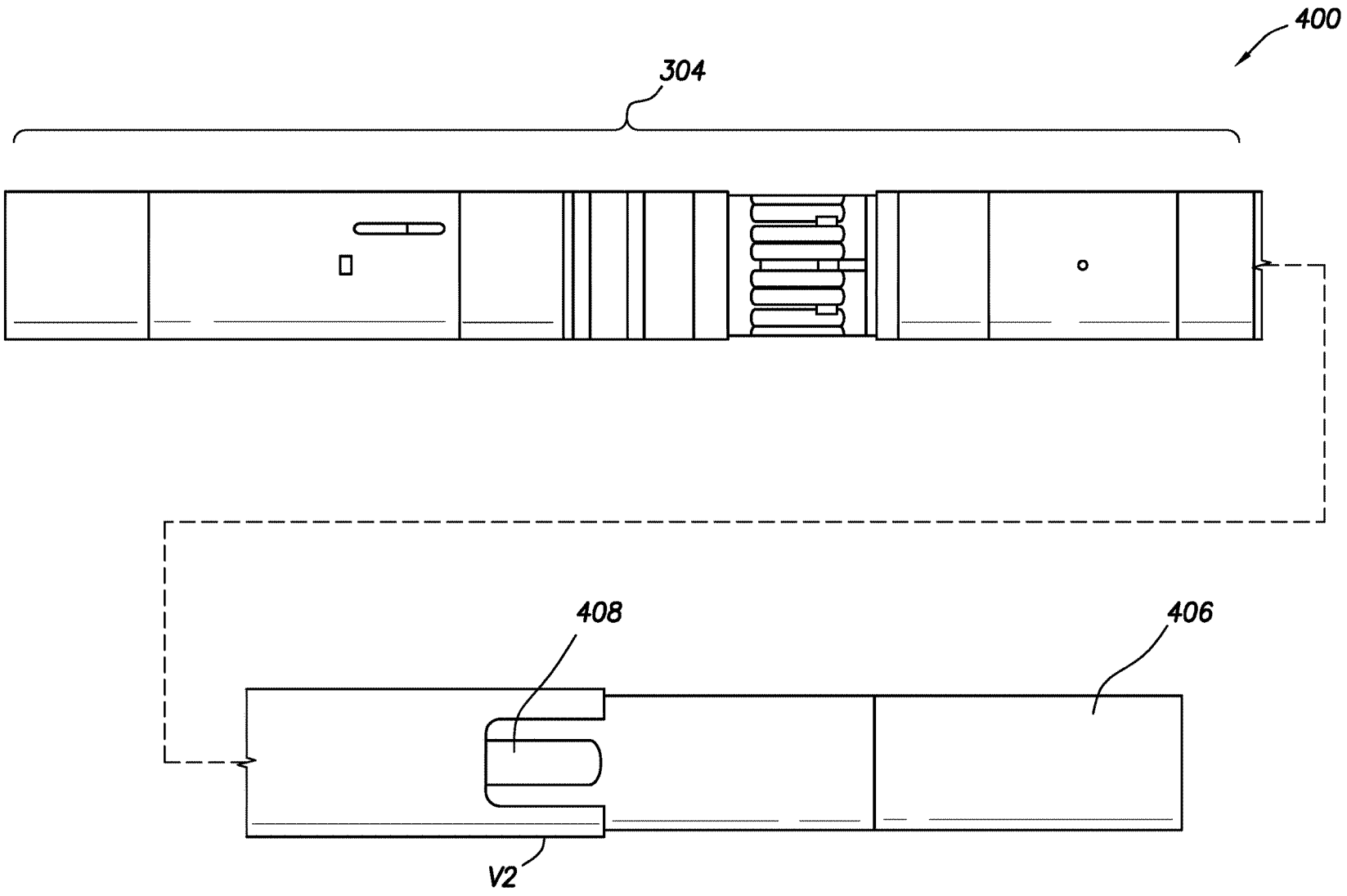
FIG. 4 illustrates the lower component of a completion tool.

FIG. 4 illustrates a section of a first downhole tool 400 that may be used for implementation of flow paths illustrated in FIGS. 2 and 3. The first downhole tool 400 may be permanently disposed within a wellbore. Alternatively, first downhole tool 400 may be removably installed. The first downhole tool 400 may comprise packer 304, valve V2, and a connector 406. In an embodiment, valve V2 may be a sleeve. In an embodiment, packer 304 may anchor the first downhole tool 400 in place. Additionally, packer 304 may seal the annulus between the first downhole tool 400 and the casing or open hole (e.g., casing 300 on FIG. 1). Packer 304 may comprise a slip, a cone, a packing-element system, and a body. Slip (not shown) may be a device capable of penetrating and gripping the casing or wellbore wall when the packer is set. The cone (not shown) may be beveled to match the back of the slip. The cone may form a ramp that may drive the slip outward and into the casing or wellbore wall when setting force may be applied. Additional setting force may energize the packing element system to create a seal between the packer body and the casing or wellbore wall.

Additionally, the first downhole tool 400 may comprise a valve V2. As illustrated, valve V2 may be in the form of a sliding sleeve that shifts from an open position to allow fluid flow through opening 408 to a closed position that blocks fluid flow. Valve V2 may allow the fluid (e.g. slurry) pumped downhole to exit the tubing (e.g., work string pipe 202 on FIG. 3) in a desired location near a screen (e.g., screen 214 on FIG. 3) which may be run below the connector 406. The slurry may then form a gravel pack in the wellbore (e.g., wellbore 302 on FIG. 3). Valve V2 may then be closed. First downhole tool 400 may further include a connector 406. Connector 406 may connect the first downhole tool 400 of the completion tool to the second downhole tool 500 (e.g., shown on FIG. 5) using any suitable technique. Suitable techniques may include, but are not limited to, a ratch latch, shear pins/screws, lugs, threads, snap rings, or the like.

Figure 5:
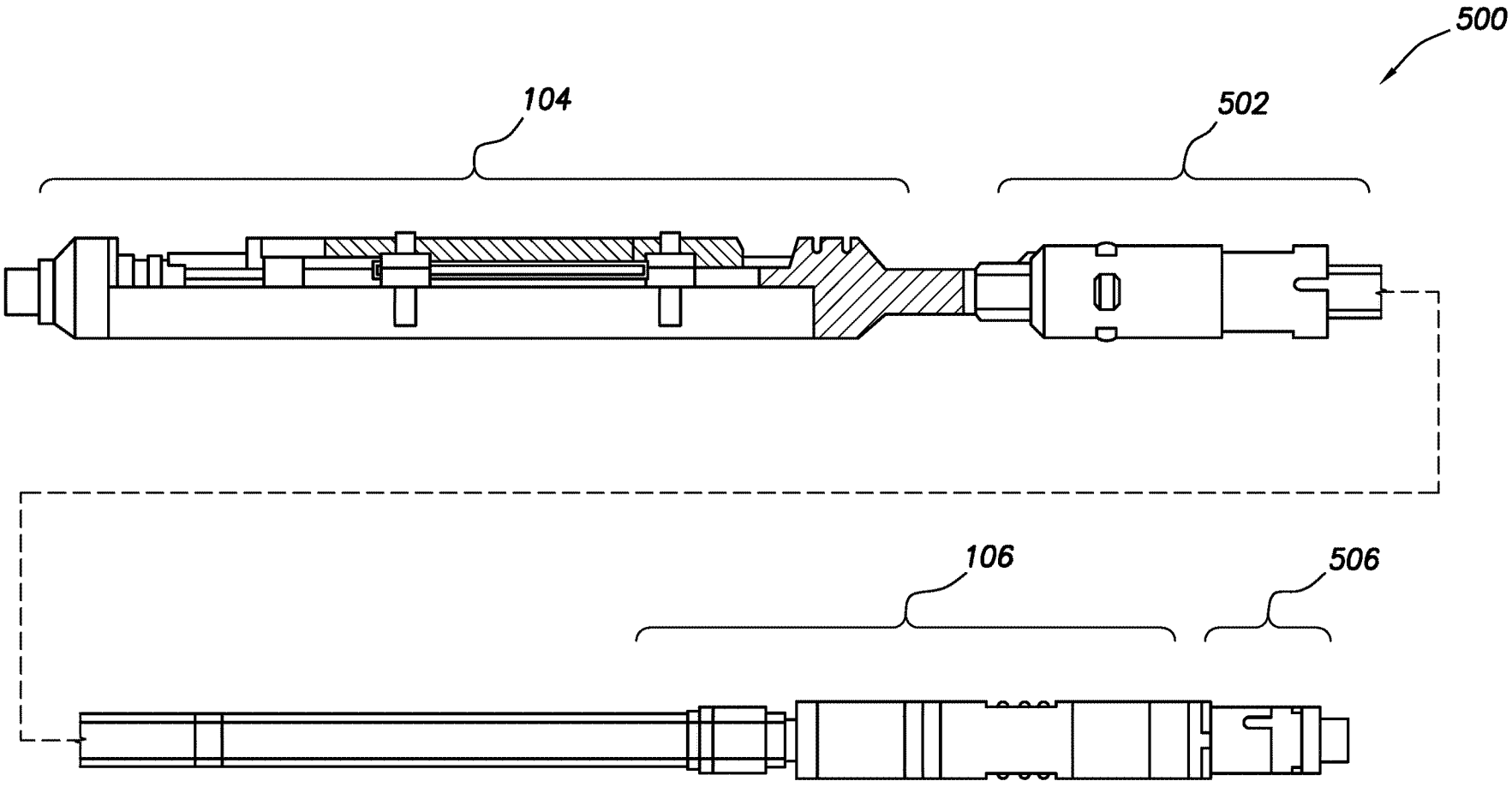
FIG. 5 illustrates second downhole tool 500 that may be used in gravel packing operations.

FIG. 5 illustrates a second downhole tool 500 that may be used in gravel packing operations. Second downhole tool 500 may be used for implementation of the flow paths illustrated in FIGS. 2 and 3. Second downhole tool 500 may be, at least partially, disposed within first downhole tool 400 (e.g., referring to FIG. 4). Second downhole tool 500 may be removed from a wellbore (e.g., wellbore 302 on FIG. 3) and then may be reused in another wellbore. Second downhole tool 500 may comprise control module 104, a packer setting tool 502, flow control module 106, and a release device 506. In an embodiment, control module 104 may be disposed above packer 304 (e.g., referring to FIGS. 3 and 4) and packer setting tool 502. Packer setting tool 502 may provide the forced needed to energize packer 304 to create a seal between the first downhole tool 400 and the casing or wellbore wall (e.g., casing 300 on FIG. 3). In an embodiment, packer setting tool 502 may be disposed inside of packer 304. Second downhole tool 500 may also comprise telemetry module 102 (not shown). Telemetry module 102 may be any suitable telemetry module capable of two-way communication. Optionally, telemetry module 102 may be any telemetry module capable of one-way communication. Telemetry module 102 may wirelessly transmit signals to and from the surface and control module 104 either directly or indirectly. Control module 104 may receive a signal from the surface indicating the opening or closing of a specified valve, valves, and/or sleeve (e.g. valves V1-V6 referring to FIG. 2).

Control module 104 may then activate pump 108 (referring to FIG. 1). In an embodiment, pump 108 may be an electro-hydraulic motor. Pump 108 may create hydraulic pressure within the control line. Hydraulic pressure in the control line may control flow control module 106.

Flow control module 106 may comprise a valve or a plurality of valves disposed at a location within a flow path. The hydraulic pressure created by pump 108 may open or close a valve and or a plurality of valves. Opening and closing specific valves may create a variety of different flow paths. In an embodiment, second downhole tool 500 may further comprise a crossover assembly (not shown). The crossover assembly may be shifted into a desired position such as, a squeeze position, a circulating position, or a reverse-out position, through the manipulation of flow paths within the wellbore. Second downhole tool 500 may further comprise a release device 506. Release device 506 may connect second downhole tool 500 with First downhole tool 400 of the completion tool. Upon completion of gravel packing operations, control module 104 may trigger release device 506 which may then disconnect second downhole tool 500 from First downhole tool 400 of the completion tool.

Figure 6:
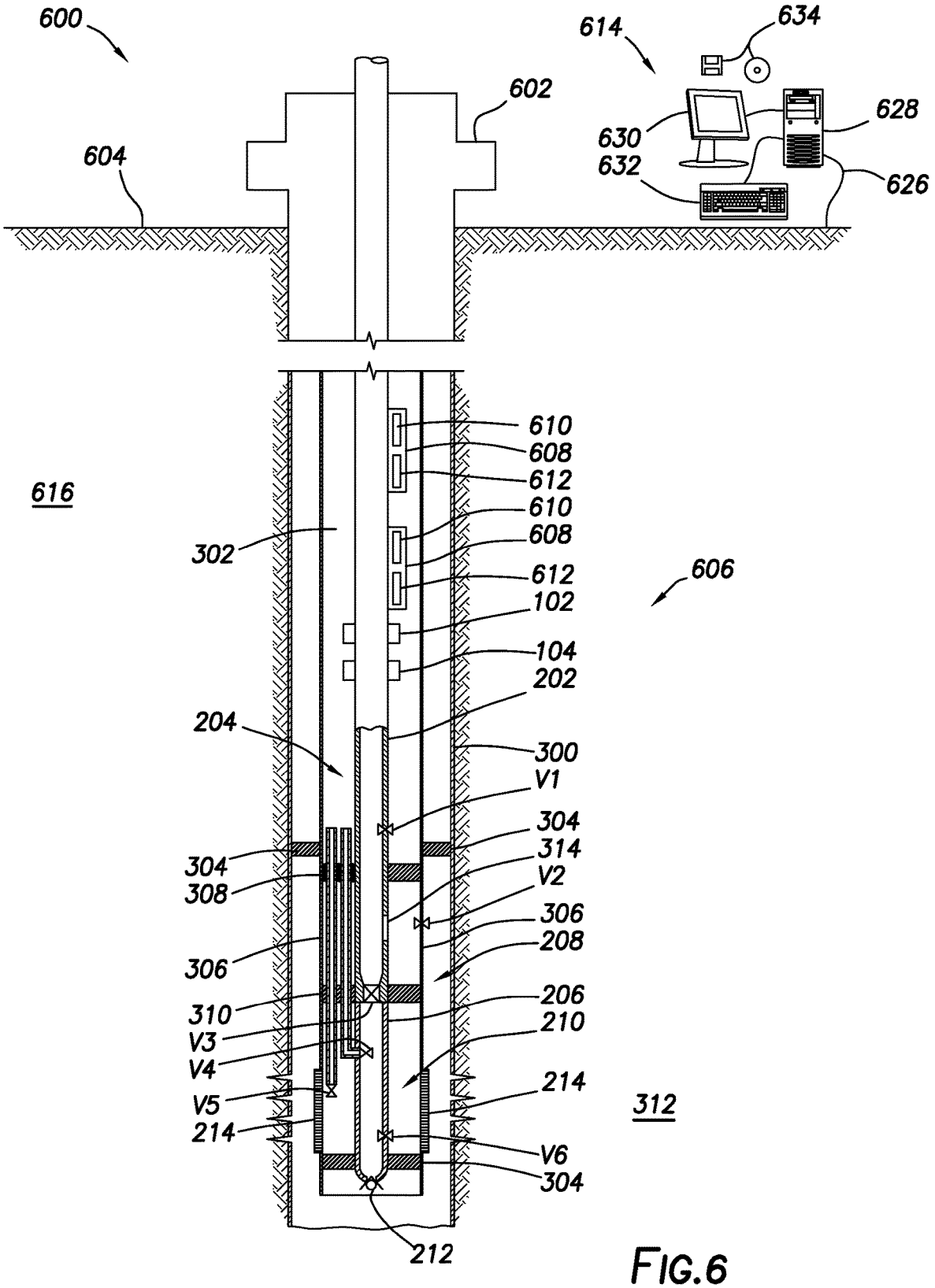
FIG. 6 illustrates an example well system for use within a wellbore capable of remotely manipulating a downhole tool into a specific position.

FIG. 6 illustrates an example in which a well system 600 for remotely manipulating the position of a valve in a downhole tool to create specific flow paths may be configured in wellbore 302. In an embodiment, well system 600 may include control module 104 and a telemetry module 102. In an embodiment, well system 600 may further include any additional tool that may create desired flow paths suitable for gravel packing operations. Optionally, well system 600 may further comprise additional tools capable of completing wellbore 302. Downhole tools may be disposed on a work string pipe 202 opposite surface 604 may be beneficial if paired with telemetry module 102. In an embodiment, telemetry module 102 may further comprise telemetry element 608. This may allow for data and/or samples to be read in real-time and/or about real-time from wellbore 302. This may also allow for the downhole tools in well system 600 to be activated and deactivated in real-time and/or about real-time from wellbore 302. A telemetry element 608 may form a real-time two-way data transmission from downhole tools in well system 600. In an optional embodiment, telemetry element 608 communicating with additional telemetry elements 608 that may form a real-time one-way data transmission from downhole tools in well system 600. In examples, downhole tool in well system 600 may further comprise samplers, gauges, plugs, ports, gravel packing tools, frac packing tools, and/or the like. It should be noted that multiple downhole tools in well system 600 may be paired with individual telemetry element 608 and/or a shared telemetry element 608. This may allow an operator on the surface to control and/or receive information from any number of downhole tools in well system 600.

In the illustrated embodiment, well system 600 may be used to gravel pack formation 616. As illustrated, a wellbore 302 may extend from wellhead through formation 616 and/or a plurality of formations 616. While wellbore 302 is shown extending generally vertically into formation 616, the principles described herein are also applicable to wellbores that extend at an angle through formation 616, such as horizontal and slanted wellbores. For example, although FIG. 6 shows a vertical or low inclination angle well, high inclination angle or horizontal placement of the well and equipment is also possible. It should further be noted that while FIG. 6 generally depicts a land-based operation, those skilled in the art will readily recognize that the principles described herein are equally applicable to subsea operations that employ floating or sea-based platforms and rigs, without departing from the scope of the disclosure.

As illustrated on FIG. 6, one or more conduits, shown here as casing 300 may be disposed in the wellbore 302. In an embodiment, packer 304 may be disposed at any location within the wellbore, thereby isolating an annulus. In an embodiment, packer 304 may be disposed between casing 300 and work string pipe 202. Packer 304 may be placed in any suitable location within wellbore 302 and should not be limited to the present disclosure. Casing 300 may be in the form of an intermediate casing, a production casing, a liner, or other suitable conduit, as will be appreciated by those of ordinary skill in the art. While not illustrated, additional conduits may also be installed in the wellbore 302 as desired for a particular application. In the illustrated embodiment, casing 300 may be cemented to the walls of wellbore 302.

A work string pipe 202 is shown as having been lowered from the surface 604 into the wellbore 302 into casing 300. The work string pipe 202 may be a series of jointed lengths of tubing coupled together end-to-end and/or a continuous (i.e., not jointed) coiled tubing, and includes one or more downhole tools in well system 600. FIG. 6 shows the work string pipe 202 extending to the surface 604. In other instances, the work string pipe 202 can be arranged such that it does not extend to the surface 604, but rather descends into wellbore 302 on a wire, such as a slickline, wireline, e-line and/or other wire. Below work string pipe 202 may be wash pipe 206. Adjacent to the bottom of wash pipe 206 may be screen 214. Screen 214 may be disposed in wellbore 302 on tubing 306. Packer 304 or a plurality of packers 304 may be disposed within wellbore 302. Any suitable packer 304 capable of isolating a specified zone in wellbore 302 may be used. In an embodiment, packer 304 may be disposed between tubing 306 and casing 300 thereby isolating first annulus 204 from second annulus 208. First seal assembly 308 may be disposed between tubing 306 and work string pipe 202 thereby isolating first annulus 204 from a port 314 of the work string pipe 202. In an embodiment, port 314 may be located in work string pipe 202. Second seal assembly 310 may be disposed between wash pipe 206 and tubing 306 thereby isolating third annulus 210 from port 314 of work string pipe 202. In an embodiment, first seal assembly 308 and second seal assembly 310 may be the same seal assembly. In an embodiment, first seal assembly 308 and second seal assembly 310 may be different seal assemblies. Any suitable seal assembly may be used may be used for first seal assembly 308 and second seal assembly 310. Valves V1-V6 may be disposed in wellbore 302 at various locations. Valves V1-V6 may be opened and/or closed at any given time thereby creating a specific flow path within wellbore 302. Flow paths within wellbore 302 may deliver fluids to a specific area within wellbore 302.

The work string pipe 202 is shown as also having multiple downhole telemetry elements 608 for sending and receiving telemetric communication signals encoded as acoustic vibrations carried on the work string pipe 202 (or in the fluid) as vibrations in the materials of its components. One of the downhole telemetry elements 608 is associated with the downhole tools in well system 600 to encode communications from the downhole tools in well system 600 and decode communications to the downhole tools in well system 600. Additional telemetry elements 608 (e.g., transceivers) can be provided to communication with other well tools, sensors and/or other components in the wellbore 302. The downhole telemetry elements 608 communicate with each other and with a surface information handling system 614 outside of the wellbore 302. Although shown on the work string pipe 202, the telemetry elements 608 can additionally or alternatively be provided on other components in the well, including the casing 300.

As illustrated, each of the downhole telemetry elements 608 may include a telemetry controller 612 for encoding/decoding communications for transmission as acoustic vibrations and a transducer 610. In an embodiment, a transducer 610 of a downhole telemetry element 608 may be mounted on a work string pipe 202 with a damper (not shown) between the work string pipe 202 and the acoustic transducer 610. The transducer 610 may translate acoustic communication signals into electrical signals and electrical signals into acoustic communication signals transmitted. The damper (not shown) damps transmission of a specified acoustic mode, such as a frequency range or vibrational mode, from the work string pipe 202 to the transducer 610. The acoustic communication signals are in a specified frequency range and/or specified vibrational mode. However, vibration from operation of the work string pipe 202 and other sources of acoustic vibration transmitted through the work string pipe 202 are noise to the acoustic communication signals. Therefore, in certain instances of a telemetry element 608 having a single transducer 610, the damper (not shown) is configured to damp a specified frequency range outside of the frequency range of the communication signals to reduce the noise received by the transducer 610.

Well system 600 may further comprise an information handling system 614. Information handling system 614 may be in signal communication with the telemetry module 102 by way of one or more telemetry elements 608. Without limitation, signals from information handling system 614 may be transmitted through one or more telemetry elements 608, which may be disposed on casing 300, to telemetry module 102. Telemetry module 102 may operate to pass information and/or measurements between information handling system 614 and control module 104. As illustrated, information handling system 614 may be disposed at surface 604. In examples, information handling system 614 may be disposed downhole. Any suitable technique may be used for transmitting signals from telemetry module 102 to information handling system 614. A communication link 626 (which may be wired or wireless, for example) may be provided that may transmit data from telemetry element 608 and/or telemetry module 102 to information handling system 614. Without limitation in this disclosure, information handling system 614 may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, information handling system 614 may be a personal computer, a network storage device, or any other suitable device and may vary in size, shape, performance, functionality, and price. Information handling system 614 may include random access memory (RAM), one or more processing resources (e.g. a microprocessor) such as a central processing unit 628 (CPU) or hardware or software control logic, ROM, and/or other types of nonvolatile memory. Additional components of information handling system 614 may include one or more of a monitor 630 an input device 632 (e.g., keyboard, mouse, etc.) as well as computer media 634 (e.g., optical disks, magnetic disks) that may store code representative of the above-described methods. Information handling system 614 may also include one or more buses (not shown) operable to transmit communications between the various hardware components. Information handling system 614 may be adapted to receive signals from telemetry module 102 that may be representative of operation of valves V1-V6. Information handling system 614 may be adapted to transmit signals to telemetry element 608 and/or control module 104, for example, to open and/or close one or more of valves V1-V6. For example, information handling system 614 may be adapted to send signals to control module 104, thereby activating or deactivating pump 108 (e.g., shown on FIG. 1). In an embodiment, more than one valve of valves V1-V6 may be opened and/or closed. In an embodiment, remotely controlling valves V1-V6 from surface may produce a variety of different flow paths within wellbore 302 thereby allowing fluid flow for gravel packing. These flow paths are discussed in more detail above with respect to FIGS. 2 and 3.

Accordingly, this disclosure describes systems and methods that may relate to subterranean operations. The systems and methods may further be characterized by one or more of the following statements:

Statement 1. A flow path system for use in a wellbore, comprising: a telemetry module operable to wirelessly receive one or more control signals from a surface location; a control module comprising a controller, a pump, and a reservoir of hydraulic fluid; and a plurality of valves;

wherein the control module is operable to hydraulically actuate one or more of the valves to open or close positions in response to the one or more control signals from the surface location to create one or more flow paths in the wellbore.

Statement 2. The system of statement 1, further comprising a plurality of control lines for the hydraulic fluid between the pump and the plurality of valves.

Statement 3. The system of statement 1 or 2, wherein the pump comprises an electro-hydraulic motor.

Statement 4. The system of any one of statements 1 to 3, wherein the plurality of valves comprises a sliding sleeve.

Statement 5. The system of any one of statements 1 to 4, wherein the telemetry module is operable to wirelessly transmit signals to the surface location.

Statement 6. The system of any one of statements 1 to 5, further comprising a plurality of transceivers spaced in the wellbore between the surface location and the telemetry module, wherein the plurality of transceivers are operable to wirelessly communicate the control signals from the surface location to the control module.

Statement 7. The system of any one of statements 1 to 6, wherein the one or more control signals comprise at least one of electromagnetic signals, acoustic signals, or combinations thereof.

Statement 8. The system of any one of statements 1 to 7, further comprising a screen, a wash pipe extending into the screen, work string pipe disposed above the wash pipe, wherein a first annulus is formed between the work string pipe and a casing, a second annulus is formed between the screen and the casing, a third annulus is formed between the wash pipe and the screen, wherein the wash pipe and the work string are at least partially disposed in a tubing supporting the screen.

Statement 9. The system of any one of statements 1 to 8, wherein the plurality of valves comprises: a first valve disposed between the first annulus and an interior of the work string pipe to provide fluid communication between the interior of the work string pipe and the first annulus; a second valve disposed between the tubing and the second annulus to provide fluid communication between the second annulus and the interior of the work string pipe by way of a port in the work string; a third valve disposed between the work string pipe and the wash pipe to provide fluid communication between an interior of the wash pipe and the interior of the work string pipe; a fourth valve disposed in a flow channel between the interior of the wash pipe and the first annulus to provide fluid communication between the interior of the wash pipe and the first annulus; a fifth valve disposed in a flow path between the first annulus and the third annulus to provide fluid communication between the first annulus and the third annulus; and a sixth valve disposed between the wash pipe and the third annulus to provide fluid communication between the wash pipe and the third annulus.

Statement 10. The system of any one of statements 1 to 9, wherein the plurality of valves comprises a first position allowing fluid communication between the first annulus and the second annulus via an interior of work string pipe and a port in the work string pipe, a squeeze position providing communication between an interior of work string pipe and the second annulus by way of the port in the work string pipe, and a circulating position providing communication between an interior of work string pipe and second annulus by way of the port and return flow from the second annulus to first annulus through the screen and an interior of the wash pipe.

Statement 11. The system of any one of statements 1 to 10, wherein a check valve is disposed in an end of the wash pipe.

Statement 12. A flow path system for use in a wellbore, comprising: a plurality of transceivers spaced in the wellbore; a telemetry module operable to wirelessly receive control signals from a surface location by way of the plurality of transceivers and to wireless transmit signals to the surface location by way of the plurality of transceivers; a control module comprising a controller, a pump, and a reservoir of hydraulic fluid; a plurality of valves; and a plurality of control lines for the hydraulic fluid, wherein the plurality of control lines are disposed between the pump and the plurality of valves; wherein the control module is operable to hydraulically actuate one or more of the valves to open or closed positions in response to the control signals from the surface location to create one or more flow paths in the wellbore.

Statement 13. The system of statement 12, further comprising a screen, a wash pipe extending into the screen, work string pipe disposed above the wash pipe, wherein a first annulus is formed between the work string pipe and a casing, a second annulus is formed between the screen and the casing, a third annulus is formed between the wash pipe and the screen, wherein the wash pipe and the work string are at least partially disposed in a tubing supporting the screen.

Statement 14. The system of statement 12 or 13, wherein the plurality of valves comprises: a first valve disposed between the first annulus and an interior of the work string pipe to provide fluid communication between the interior of the work string pipe and the first annulus; a second valve disposed between the tubing and the second annulus to provide fluid communication between the second annulus and the interior of the work string pipe by way of a port in the work string; a third valve disposed between the work string pipe and the wash pipe to provide fluid communication between an interior of the wash pipe and the interior of the work string pipe; a fourth valve disposed in a flow channel between the interior of the wash pipe and the first annulus to provide fluid communication between the interior of the wash pipe and the first annulus; a fifth valve disposed in a flow path between the first annulus and the third annulus to provide fluid communication between the first annulus and the third annulus; and a sixth valve disposed between the wash pipe and the third annulus to provide fluid communication between the wash pipe and the third annulus.

Statement 15. A method for gravel packing comprising: transmitting one or more control signals from a surface location to a telemetry module disposed in a wellbore by way of wireless communication; pressuring one or more control lines with a hydraulic fluid in response to the control signals; changing a position of at least one of a plurality of valves with the one or more control signals to create at least one flow path in the wellbore; and flowing a treatment fluid comprising gravel into an annulus around a screen to thereby pack the annulus with the gravel, wherein the treatment fluid flows through the at least one flow path.

Statement 16. The method of statement 15, further comprising transmitting one or more signals from the telemetry module to the surface location by way of wireless communication.

Statement 17. The method of statement 15 or 16, wherein the transmitting the one or more control signals from the surface location to the telemetry module comprises transmitting the one or more control signals to one or more transceivers disposed in the wellbore and then transmitting the one or more control signals from the one or more transceivers to the telemetry module.

Statement 18. The method of any one of statements 15 to 17, wherein the one or more control signals causes one or more of the plurality of valves to open to cause fluid to flow from a first annulus, into an interior of a work string pipe, and into a second annulus, wherein the first annulus is formed between the work string pipe and a casing, wherein the second annulus is formed between the screen and the casing.

Statement 19. The method of any one of statements 15 to 18, wherein the one or more control signals causes one or more of the plurality of valves to open causing a gravel pack fluid to flow through a work string pipe, into a second annulus, and squeezing through perforations into a formation, wherein the second annulus is formed between the screen and a casing, and wherein the gravel pack fluid comprises a carrier fluid and gravel.

Statement 20. The method of any one of statements 15 to 19, wherein the one or more control signals causes one or more of the plurality of valves to open causing a gravel pack fluid to flow down a work string pipe and into a second annulus, wherein the second annulus is formed between the screen and a casing, and wherein the gravel pack fluid comprises a carrier fluid and gravel, and wherein the gravel pack fluid returns from the second annulus to a first annulus via the screen and an interior of a wash pipe, wherein gravel in the gravel pack fluid is deposited in the second annulus.

Although the present invention and its advantages have been described in detail, it should be understood that various changes, substitutions and alterations may be made herein without departing from the spirit and scope of the invention as defined by the appended claims. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "including," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein.

What is claimed is:

1. A flow path system for use in a wellbore, comprising:

a telemetry module operable to wirelessly receive one or more control signals from a surface location;

a control module comprising a controller, a pump, and a reservoir of hydraulic fluid; and a plurality of valves;

wherein the control module is operable to hydraulically actuate one or more of the valves to open or close positions in response to the one or more control signals from the surface location to create one or more flow paths in the wellbore, wherein at least one flow path comprises a screen, a wash pipe extending into the screen, and a work string pipe disposed uphole to the wash pipe, wherein a first annulus is formed between the work string pipe and a casing, a second annulus is formed between the screen and the casing, a third annulus is formed between the wash pipe and the screen, wherein the wash pipe and the work string pipe are at least partially disposed in a tubing supporting the screen.

2. The system of claim 1, further comprising a plurality of control lines for the hydraulic fluid between the pump and the plurality of valves.

3. The system of claim 1, wherein the pump comprises an electro-hydraulic motor.

4. The system of claim 1, wherein the plurality of valves comprises a sliding sleeve.

5. The system of claim 1, wherein the telemetry module is operable to wirelessly transmit signals to the surface location.

6. The system of claim 1, further comprising a plurality of transceivers spaced in the wellbore between the surface location and the telemetry module, wherein the plurality of transceivers are operable to wirelessly communicate the control signals from the surface location to the control module.

7. The system of claim 1, wherein the one or more control signals comprise at least one of electromagnetic signals, acoustic signals, or combinations thereof.

8. The system of claim 1, wherein the plurality of valves comprises a first valve disposed between the first annulus and an interior of the work string pipe to provide fluid communication between the interior of the work string pipe and the first annulus.

9. The system of claim 8, wherein the plurality of valves further comprises:

a second valve disposed between the tubing and the second annulus to provide fluid communication between the second annulus and the interior of the work string pipe by way of a port in the work string;

a third valve disposed between the work string pipe and the wash pipe to provide fluid communication between an interior of the wash pipe and the interior of the work string pipe;

a fourth valve disposed in a flow channel between the interior of the wash pipe and the first annulus to provide fluid communication between the interior of the wash pipe and the first annulus;

a fifth valve disposed in a flow path between the first annulus and the third annulus to provide fluid communication between the first annulus and the third annulus; and a sixth valve disposed between the wash pipe and the third annulus to provide fluid communication between the wash pipe and the third annulus.

10. The system of claim 8, wherein the plurality of valves comprises a first position allowing fluid communication between the first annulus and the second annulus via an interior of work string pipe and a port in the work string pipe, a squeeze position providing communication between an interior of work string pipe and the second annulus by way of the port in the work string pipe, and a circulating position providing communication between an interior of work string pipe and second annulus by way of the port and return flow from the second annulus to first annulus through the screen and an interior of the wash pipe.

11. The system of claim 8, wherein a check valve is disposed in an end of the wash pipe.

12. A flow path system for use in a wellbore, comprising:

a plurality of transceivers spaced in the wellbore;

a telemetry module operable to wirelessly receive control signals from a surface location by way of the plurality of transceivers and to wireless transmit signals to the surface location by way of the plurality of transceivers;

a control module comprising a controller, a pump, and a reservoir of hydraulic fluid;

a plurality of valves;

a plurality of control lines for the hydraulic fluid, wherein the plurality of control lines are disposed between the pump and the plurality of valves; and wherein the control module is operable to hydraulically actuate one or more of the valves to open or closed positions in response to the control signals from the surface location to create one or more flow paths in the wellbore, wherein at least one flow path comprises a screen, a wash pipe extending into the screen, and a work string pipe disposed uphole to the wash pipe, wherein a first annulus is formed between the work string pipe and a casing, a second annulus is formed between the screen and the casing, a third annulus is formed between the wash pipe and the screen, wherein the wash pipe and the work string pipe are at least partially disposed in a tubing supporting the screen.

13. The system of claim 12, wherein the plurality of valves comprises a first valve disposed between the first annulus and an interior of the work string pipe to provide fluid communication between the interior of the work string pipe and the first annulus.

14. The system of claim 13, wherein the plurality of valves further comprises:

a second valve disposed between the tubing and the second annulus to provide fluid communication between the second annulus and the interior of the work string pipe by way of a port in the work string;

a third valve disposed between the work string pipe and the wash pipe to provide fluid communication between an interior of the wash pipe and the interior of the work string pipe;

a fourth valve disposed in a flow channel between the interior of the wash pipe and the first annulus to provide fluid communication between the interior of the wash pipe and the first annulus;

a fifth valve disposed in a flow path between the first annulus and the third annulus to provide fluid communication between the first annulus and the third annulus; and a sixth valve disposed between the wash pipe and the third annulus to provide fluid communication between the wash pipe and the third annulus.

15. A method for gravel packing comprising: transmitting one or more control signals from a surface location to a telemetry module disposed in a wellbore by way of wireless communication; pressuring one or more control lines with a hydraulic fluid in response to the control signals; changing a position of at least one of a plurality of valves with the one or more control signals to create at least one flow path in the wellbore, the at least one flow path comprising a screen, a wash pipe extending into the screen, and a work string pipe disposed uphole to the wash pipe; wherein changing the position of the plurality of valves alters the flow path for allowing fluid communication between a first annulus and a second annulus via an interior of a work string pipe and a port in the work string pipe; providing fluid communication between an interior of the work string pipe and a second annulus by way of the port in the work string pipe; and providing fluid communication between the interior of the work string pipe and the second annulus by way of the port and return flow from the second annulus to the first annulus through the screen and an interior of the wash pipe.

16. The method of claim 15, further comprising:

flowing a treatment fluid comprising gravel around the screen to thereby pack the annulus with the gravel, wherein the treatment fluid flows through the at least one flow path; and transmitting one or more signals from the telemetry module to the surface location by way of wireless communication.

17. The method of claim 15, wherein the transmitting the one or more control signals from the surface location to the telemetry module comprises transmitting the one or more control signals to one or more transceivers disposed in the wellbore and then transmitting the one or more control signals from the one or more transceivers to the telemetry module.

18. A method for gravel packing comprising:

transmitting one or more control signals from a surface location to a telemetry module disposed in a wellbore by way of wireless communication;

pressuring one or more control lines with a hydraulic fluid in response to the control signals;

changing a position of at least one of a plurality of valves with the one or more control signals to create at least one flow path in the wellbore; and flowing a treatment fluid comprising gravel into an annulus around a screen to thereby pack the annulus with the gravel, wherein the treatment fluid flows through the at least one flow path, wherein the one or more control signals causes one or more of the plurality of valves to open to cause fluid to flow from a first annulus, into an interior of a work string pipe, and into a second annulus, wherein the first annulus is formed between the work string pipe and a casing, wherein the second annulus is formed between the screen and the casing.

19. A method for gravel packing comprising:

transmitting one or more control signals from a surface location to a telemetry module disposed in a wellbore by way of wireless communication;

pressuring one or more control lines with a hydraulic fluid in response to the control signals;

changing a position of at least one of a plurality of valves with the one or more control signals to create at least one flow path in the wellbore; and flowing a treatment fluid comprising gravel into an annulus around a screen to thereby pack the annulus with the gravel, wherein the treatment fluid flows through the at least one flow path, wherein the one or more control signals causes one or more of the plurality of valves to open causing a gravel pack fluid to flow through a work string pipe, into a second annulus, and squeezing through perforations into a formation, wherein the second annulus is formed between the screen and a casing, and wherein the gravel pack fluid comprises a carrier fluid and gravel.

20. A method for gravel packing comprising:

transmitting one or more control signals from a surface location to a telemetry module disposed in a wellbore by way of wireless communication;

pressuring one or more control lines with a hydraulic fluid in response to the control signals;

changing a position of at least one of a plurality of valves with the one or more control signals to create at least one flow path in the wellbore; and flowing a treatment fluid comprising gravel into an annulus around a screen to thereby pack the annulus with the gravel, wherein the treatment fluid flows through the at least one flow path, wherein the one or more control signals causes one or more of the plurality of valves to open causing a gravel pack fluid to flow down a work string pipe and into a second annulus, wherein the second annulus is formed between the screen and a casing, and wherein the gravel pack fluid comprises a carrier fluid and gravel, and wherein the gravel pack fluid returns from the second annulus to a first annulus via the screen and an interior of a wash pipe, wherein gravel in the gravel pack fluid is deposited in the second annulus.

* * * * *